US005228570A

United States Patent [19]

Robinson

[11] Patent Number: 5,228,570

[45] Date of Patent: Jul. 20, 1993

[54] WRENCH SOCKET STORAGE RACK WITH QUICK RELEASE MECHANISMS

[75] Inventor: Donald F. Robinson, 151 S. Craig Pl., Lombard, Ill. 60148

[73] Assignee: Donald F. Robinson, Lombard, Ill.

[21] Appl. No.: 881,236

[22] Filed: May 11, 1992

[51] Int. Cl.[5] ..... B65D 85/20

[52] U.S. Cl. ..... 206/378; 81/177.4; 81/177.85; 206/375; 211/70.6

[58] Field of Search ..... 206/375-378; 81/177.4, 177.85, 462; 211/70.6, 94

[56] References Cited

U.S. PATENT DOCUMENTS

| | | | |
|---|---|---|---|
| 1,583,331 | 5/1926 | Aley et al. | 81/177.4 |
| 1,596,951 | 8/1926 | Smith | 206/375 |
| 1,712,473 | 5/1929 | McWethy | 206/378 |
| 2,832,296 | 4/1958 | Livermont | 81/177.85 |
| 4,253,356 | 3/1981 | Martinmaas | 206/378 X |
| 4,302,990 | 12/1981 | Chrichton et al. | 206/378 X |
| 4,337,860 | 7/1982 | Carrigan | 206/376 |
| 4,352,306 | 10/1982 | Martinmaas | 206/378 X |
| 4,497,405 | 2/1985 | Mikic et al. | 206/378 |
| 4,621,738 | 11/1986 | DeLucchi | 211/70.6 |
| 4,635,801 | 1/1987 | Oren | 211/70.6 |
| 4,727,782 | 3/1988 | Yang | 81/177.4 X |
| 4,826,021 | 5/1989 | Burrell | 211/70.6 |
| 4,927,020 | 5/1990 | Randy | 206/378 |
| 4,941,571 | 7/1990 | Barrett et al. | 206/378 |

*Primary Examiner*—Bryon P. Gehman

[57] ABSTRACT

Apparatus for holding and selectively releasing a plurality of wrench sockets of the type having a drive opening therein includes an elongated rack having a pair of slots open on outer faces thereof and in communication with an internal, longitudinally extending recess having a width greater than the width of the slots and a plurality of retainer assemblies mounted in spaced relation along the length of said recess. Each retainer assembly includes a support post projecting outwardly of one face of the rack through an adjacent slot therein for engagement within the opening of a wrench socket placed on the post. A releasable detent is provided on each post for detaining engagement with a wrench element placed on the post, and a release button, accessible through the slot on an opposite face of the rack is provided for manual, quick releasing of the detent to permit easy withdrawal of the wrench socket from the post.

12 Claims, 2 Drawing Sheets

WRENCH SOCKET STORAGE RACK WITH QUICK RELEASE MECHANISMS

BACKGROUND OF THE INVENTION

1. Field of the Invention

This invention relates to the general field of storage devices, particularly those for holding, retaining and or the detention of articles. Being more specific, an improved wrench socket storage rack not only enables the organization of socket sets by dimensional graduations, but also includes means providing instantaneous socket release from the wrench socket storage rack with the touch of a finger tip on a release button.

2. Discussion of Prior Art

Wrench socket storage devices have been on the market and in the work place since the advent of wrench sockets. These devices have ranged from a tool box having divisions therein carefully configured to accommodate the graduated size of each socket to hand held devices having extremely sharp spring clip socket retaining devices, which devices leave quite a bit to be desired. Inventors have made futile and not so futile attempts at securing sockets to holding fixtures. Credit should always be given where credit is due especially for their part in trying to solve the age old problem of wrench socket storage. For example, U.S. Pat. No. 1,712,473 to McWethy's for "socket set" is a fine example of how sockets may be stored, although design does not provide for mobility or movement of multiple socket posts in a socket storage rack, nor does McWethy provide a release mechanism for the ease of socket removal/or reattachment. U.S. Pat. No. 2,065,341 to McNaught for a "Socket Wrench Kit" is quite limited whereas the sockets are not compatible to turning devices such as a ratchet, a speed handle but must use a bar of hexagonal stock with the bar bent laterally, e.g. ninety degrees to resemble a one half inch "Allen" wrench. U.S. Pat. No. 3,405,377 Pierce, for a "Holder For Socket wrench heads" does not have much to offer within the realm of practicality, the holder does not compensate for the majority of tool manufacturers having variable wall thicknesses in their tools. Additionally, magnets for securing the sockets to the holder seems to be counterproductive and costly. U.S. Pat. No. Des. 256,425 for a "Socket Wrench Holder" of Hayes is also limited to the manufacture of sockets used in the "Socket Wrench Holder". U.S. Pat. No. 4,337,860 Carrigan for a "Detachable Wrench Set Organizer And Storage Unit" appears to have too much complexity in the mechanics of its own design. U.S. Pat. No. 4,826,021 to Burrell for a "Wrench Socket Holder" does not provide a would be purchaser the assurance that each socket will remain in place should the "Wrench Socket Holder" be inadvertently dropped onto a hard surface. It would appear that each of the sockets would be seeking their own direction, and the absence of a socket retaining/release system is quite evident. U.S. Pat. No. 4,941,571 to Barrett and Malloy for a "Wrench Socket Holder" follows suit like the above mentioned patent because any unintended misuse of the well thought out concept thereof does not provide a consumer with any additional protection should the "Wrench Socket Holder" be advertently dropped. The items being stored upon the holder could/would become dislodged causing an unwanted problem contrary to the intended purpose of this invention which is to function as a "Wrench Socket Holder", for keeping sockets secure and safe, i.e., free from danger or risk of loss.

Quick release mechanisms for securing a wrench socket to a ratchet and for permitting removal of a wrench socket from a ratchet have been known and racks have been known for the sole purpose of storing wrench when not in use. For example, a type of ratchet assembly shown in U.S. Pat. No. 3,208,318 awarded to Roberts and entitled "Quick Release for Socket Wrenches" depicts a rounded button and movable pin machined as one unit incorporating a compression spring. When depressed, a ball is allowed to withdraw into a detent thus freeing a wrench socket to be installed/removed from the ratchet wrench. U.S. Pat. No. 4,524,652 to Wenzel and Duke and U.S. Pat. No. 4,524,653 to Konecy are somewhat identical in their principal concept and are quite elaborate in their design over the simple well engineered design of Roberts. U.S. Pat. No. 4,537,100 to Palm involves a "Push-on/Quick Release Locking Arrangement for Socket Wrench Extension". This application is intended to function for a push-on mounting of a socket on an extension having a locking/quick release arrangement but fails to provide any usefulness in the field of mechanics. U.S. Pat. No. 4,553,453 for a "Stepless Wrench Including Quick Release Mechanism" to John D. and Jock D. Dempsey incorporates a quick release mechanism as identified with all of the above mentioned patents. The primary function of ratchets, regardless of how elaborate the chemistry the inventors have built into their designs, all produce the same result which is to install/remove a nut/bolt by means of a ratcheting device and by flipping a lever or a twist of a thumb switch to change the direction of ratcheting for either removal/installation of a nub/bolt. A spring pressured pawl against gear teeth is a substantial part of the elaborate properties within the workings of ratchet wrenches which have a depressible lever or button for permitting a wrench socket to be removed or replaced. These type of ratchets are a must for any mechanic's tool box.

The prior art of previously issued patents on holding devices for sockets do not provide a user with the means for securing a socket to a holder for proper storage and having the capability to removal of that same socket from the storage device by pressing a quick release/quick disconnect button or lever. The present invention allows flexibility and mobility in that the device can be hand carried, rough handled and even inadvertently dropped onto a hard surface presumably without the discharge of a single socket from the storage rack. Referencing now, the term "presumably" is used because of the known fact that some wrench socket manufacturers do not provide indentations within female end of a wrench socket to accept the "spring loaded closed" ball check detents common on male member driving devices, e.g. ratchet wrenches. In accordance with the rack system of the present invention, the only means by which a socket can be removed/installed/replaced is by depressing a release button on "QUICK RELEASE MECHANISM". All of the patents including the patent numbers listed in References Cited for all devices with Quick Disconnects and the likes and all Socket Storage devices and the likes are well intended, well thought out submissions by their inventors, but of the prior art that has been researched from 1886 to the present, none have approached the reality of the basic needs of the mechanic until now.

OBJECTS AND ADVANTAGES

Thus, it is a primary object and advantage of the present invention to provide a new and much improved wrench socket storage rack and more particularly a socket storage rack enabling a user, to remove/install/replace a single socket by depressing a quick release button.

It is another advantage of the present unique invention to provide a storage rack system easily operated even when a user's hands are covered with oil/grease, and merely by depressing a quick release button which compresses a spring for releasing the ball check into an indentation of a cylindrical pin allowing only that single socket to be released. Further objects and advantages of the present invention will become obvious and apparent from the following descriptions and accompanying drawings.

BRIEF SUMMARY OF THE INVENTION

The foregoing and other objects and advantages of the present invention are accomplished in a new and improved wrench socket storage rack having a plurality of quick release mechanisms to support a plurality of wrench elements of design whereby a female end is a driven end and joins the male end of a driver device such as e.g. a ratchet wrench, an air/electric impact wrench, a flex handle, a sliding T-bar handle, a speeder wrench, socket extensions, universal joints, standard and/or metric types of drivers of sizes such as ¼", ⅜", ½" and ¾" drives. Driven wrench elements also include standard and deepwell sockets, stud removers, crowfoot wrench, Allen wrenches, Phillips, Torx bits, and slotted screwdriver bits. The quick release mechanism have rotational and non-rotational male members and have limiting longitudinal movement along a longitudinal axis of the rack. Each quick release mechanism is independent of other mechanism and has limited freedom of movement along the longitudinal axis of the rack in order to accept smaller/larger dimensioned sockets. A detachable handle may be provided on the rack to facilitate carriage of the storage rack but is optional for the consumer(s) as noted by both the presence and absence of said handle in the figured drawings.

BRIEF DESCRIPTION OF THE DRAWINGS

For the purpose of a better understanding of the present invention, its objects and features will be more fully appreciated from the following details of illustrated embodiment taken in connection with the accompanying drawings and appended claims.

DESCRIPTION OF A PREFERRED EMBODIMENT OF THE INVENTION

Figures 1, 2:
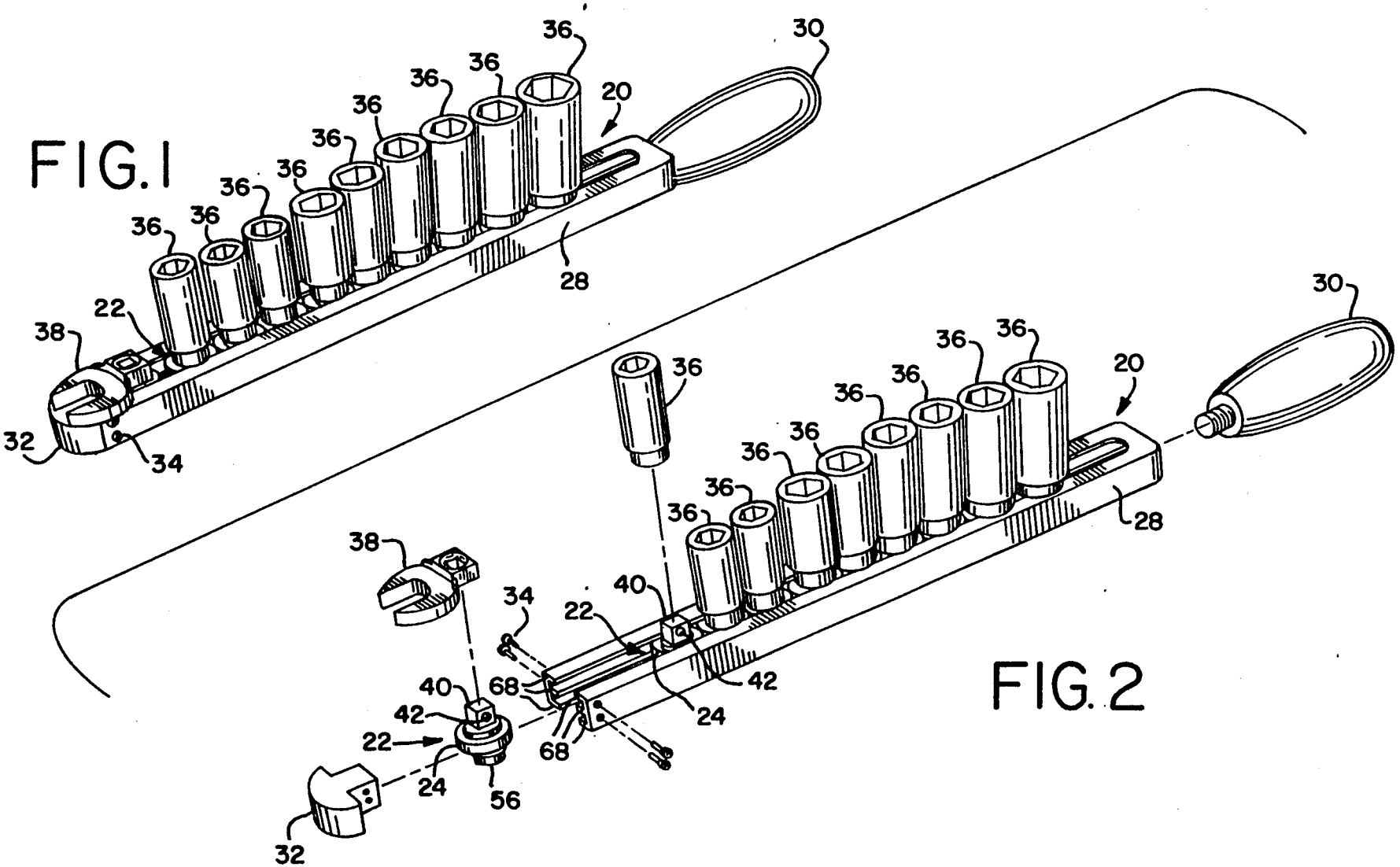
FIG. 1 is an isometrical view of a wrench socket storage rack embodying the present invention.
FIG. 2 is a partially emploded isometrical view of the preferred embodiment of the present invention.

Referring now more particularly to the drawings, a wrench socket storage rack with quick release mechanisms embodying the present invention as an assembly as illustrated in FIGS. 1 and 2 and identified by reference number 20. The wrench socket storage rack 20 illustrates the adaptability of supporting a plurality of quick release mechanisms 22, in turn supporting a plurality of wrench sockets 36 of graduating sizes, with the driven end of each socket being of common size to each other. The wrench socket storage rack 20 supports a plurality of quick release mechanisms 22, each mechanism mounted for longitudinal movement within the confines of a pair of side rails 28 and movement is determined with respect to the graduated sizing of sockets 36. An end cap 32 is provided to secure a plurality of quick release mechanisms 22 within the confines of the rails 28 and the end cap 30 is secured in place with retaining screws 34. Referring also to FIGS. 1 and 2, these FIGS. illustrate the wrench socket storage rack 20 with and without a carrying handle 30, respectively.

Figure 5:
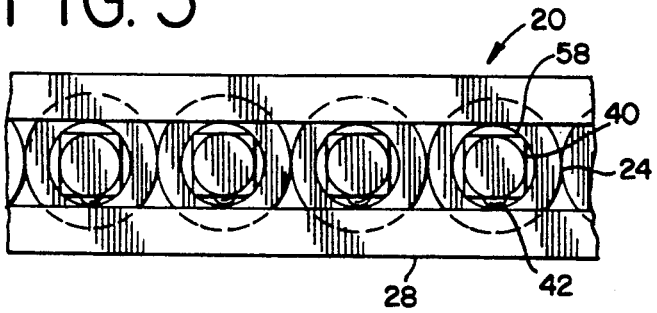
FIG. 5 is a partial plan view thereof.
Figure 6:
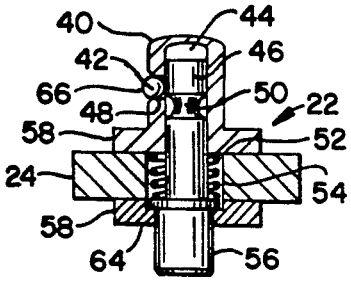
FIG. 6 is a cross sectional view taken substantially along lines 6—6 of FIG. 4 thereof.

The wrench socket storage rack 20 supports a plurality of quick release mechanisms 22 having studs or posts 40 extending upwardly and outwardly from the main body of rack for supporting a plurality of wrench sockets 36. Each quick release mechanism 22 (FIGS. 4, 6, 7 and 8) includes a stud 40 or post of square shaped cross-section as depicted in FIG. 5 having a ball check 42 or detent ball recessed and peened as at 66 to be retained within a transverse bore 48 forming a ball check cavity in the post. The detent ball 42 is biased outwardly into a recess on a socket 36 by a pin 46 of a push button having an enlarged shoulder 56. The pin 46 has a groove 50 and is mounted within the bore 44 of a body 24 of each quick release mechanism 22 and a coiled compression spring 52 seated within chamber 54 biases the pin 46 outwardly to secure socket 36 to the quick release mechanism 22. Referring to FIG. 6, the ball check 42 is peened as at 66, to retain the same on the push button assembly and a member 58 is about an opening 64 for retention of the spring 52, push button 56 and detent ball 42 within the quick release mechanisms 22.

Referring once again to FIGS. 4, 6, 7 and 8, the quick release mechanism 22 has incorporated a shoulder member 58 above and below the large cylindrical body 24, and the shoulder members 58 stabilizes the quick release mechanism 22 horizontally and laterally within the rails 68 while the large cylindrical body 24 stabilizes the quick release mechanisms 22 vertically within the rails 68 of the wrench socket storage rack 20.

Figure 7:
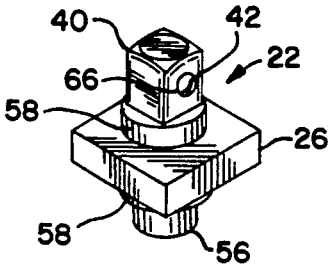
FIG. 7 is an isometrical view of an embodiment of a quick release mechanism having a non-rotational male member.

FIG. 7 is an isometric view of the quick release mechanism 22 and also having (as described in FIG. 4), shoulders 58 incorporated above and below a large square body 26 which is square by design to limit the movement to a non-rotational status but having the ability to move longitudinally within the rails 68. As previously mentioned, the shoulders 58 stabilize the quick release mechanism 22 horizontally and laterally within the rails 68 while the body 26 stabilizes the quick release mechanism 22 vertically within the rails 68 of the wrench socket storage rack 28.

Figure 8:
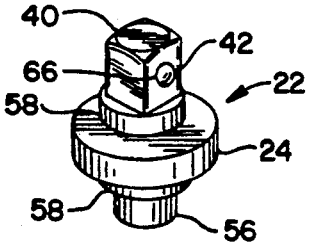
FIG. 8 is an isometrical view of an embodiment of a quick release mechanism having a rotational male member.

FIG. 8 is an isometric view of a quick release mechanism 22 and also having (as described in FIGS. 4 and 7) shoulders 58 incorporated above and below the body 24 which is round by design so as not to limit the rotational movement yet still permitting movement longitudinally within the rails 68.

Figure 3:
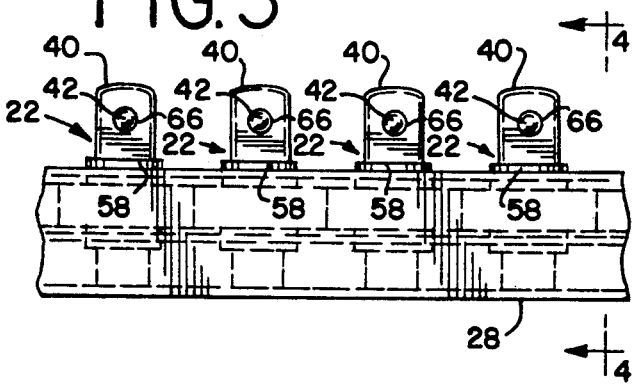
FIG. 3 is an enlarged partial side view thereof.
Figure 4:
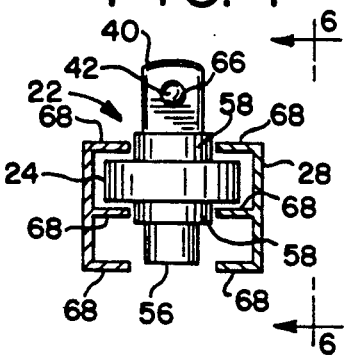
FIG. 4 is an enlarged end view taken substantially along lines 4—4 of FIG. 3 thereof.

The shoulders 58 stabilize the quick release mechanism 22 horizontally and laterally within the rails 68 while the body 24 stabilizes the quick release mechanism 22 vertically within the rails 68 of the wrench storage rack body 28. Referring to FIG. 3, which comprises a partial side view of the socket storage rack body 28, the upper shoulder member 58 extending slightly above the top of rails 68 of the socket storage rack body 28 and the figure illustrates a frontal view of the ball check 42 exposed on the flat of a stud or post 40 having 3 other identical sides except for excluding a ball check 42. FIG. 5 is a partial top or plan view of a socket storage rack 20 illustrating all 4 sides of each stud 40, the external portion of the ball check 42 and the upper portion of a shoulder 58.

OPERATION OF THE INVENTION

Referring now more particularly to the drawings. All sizes, shapes, angles and measurements if any are approximate. FIGS. 1 and 2 illustrate what a typical "wrench socket storage rack with quick release mechanisms" looks like. The socket storage rack 20 is fabricated from extruded aluminum, polypropylene thermoplastic, thermoset plastics commonly used for flexible automobile body panels including front and rear fascias or any of many materials that may be available to the industry. The socket storage rack body 28 supports a plurality of non-ratcheting quick release mechanisms 22. As illustrated in FIGS. 1, 2, 3, 4, 5, 6 and 8, all mechanisms 22 are mounted for rotation within the rails 68 of the socket storage rack 28 and the ability to rotate is for the purpose of identifying the size of the wrench sockets 36 for removal of a certain size of said socket when necessary.

A plurality of wrench sockets 36 may be seated upon the male members or studs 40 and are secured by the ball checks 42 which lock into an indentation provided within the axially extending drive end cavity or female end of a wrench socket 36. The ball check detents 42 locking ability within a wrench socket 36 is attained when a quick release mechanisms 22 push button 56 is in or has been returned to a fully outwardly extended position by the coiled compression spring 52 acting upon the inside portion of the push button shoulder 56 within the chamber 54 housing the compression spring 52. The entire push button assembly 46 consisting of the push button with enlarged shoulder 56, actuating pin, rod and piston is a single machined part moving against and with the coiled compression spring 52 to secure a wrench socket 36 on a post 40. Conversely, depressing said push button assembly 46 releases a wrench socket 36 from the post 40 as the ball check 42 can retract into the cylindrical cavity bore 48 and into the actuating pin detent groove 50.

The plurality of non-ratcheting quick release mechanisms 22 move freely along the longitudinal axis of the socket storage rack body 28 to accommodate the graduated sizes of socket sets.

FIG. 7 illustrates a non-ratcheting, non-rotational quick release mechanism 22 capable of performing the entire scenario outlined above as referred to in FIGS. 1, 2, 4, 5, 6 and 8 with one exception. To reiterate, the quick release mechanism 22 in FIG. 7 is non-ratcheting and non-rotational.

Referring back to FIGS. 1 and 2. All quick release mechanisms 22 are retained within the rails 68 of the socket storage rack 28 with an end cap 32 secured with screws 34. Handles 30 (simple by design) will contribute to the handling qualities of said socket storage rack 28.

The availability of wrench socket storage racks 20 with quick release mechanisms 22 in accordance with the present invention is not limited to any one size of drives or studs 40 and different sizes of quick release mechanisms 20 to accommodate e.g. $\frac{1}{4}''$ sq. drives, $\frac{3}{8}''$ sq. drives, $\frac{1}{2}''$ sq. drives, $\frac{3}{4}''$ and 1" sq. drives may be provided, if required.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. Apparatus for holding and selectively releasing a plurality of wrench elements of the type having a drive opening therein comprising:

an elongated rack having a pair of outer faces, an elongated internal longitudinally-extending recess between said faces, each face having an elongated slot extending between opposite ends of said rack, said slots in communication with said recess, said recess having a transverse width greater than a transverse width of said slots; and a plurality of separate retainer assemblies mounted in spaced relation along the length of and within said recess, each retainer assembly including a support post projecting outwardly through the slot of one of said outer faces and having an outer portion adapted for retaining engagement within a drive opening of a wrench element that is placed on said post, each retainer assembly including releasable detent means on the support post thereof for detaining engagement with a wrench element that has been placed on said post, each retainer assembly further including manual release means accessible through the slot on the other face of said rack for manually releasing said detent means thereby permitting withdrawal of an engaged wrench element away from said support post.

2. The apparatus of claim 1, wherein:

said rack includes a closure means at each of the opposite ends for closing off opposite ends of said recess to retain said retainer assemblies in said recess.

3. The apparatus of claim 2, wherein:

said closure means at one of said ends is detachably secured on said rack so that the number of said plurality of said retainer assemblies mounted in said recess may be changed.

4. The apparatus of claim 2, including:

handle means attached to one of said closure means extending outwardly of said rack for supporting said rack from an end thereof.

5. The apparatus of claim 4, wherein:

one of said closure means is integrally formed on said rack and said handle means is detachably mounted thereon.

6. The apparatus of claim 5, wherein:

the other of said closure means at an opposite end of said rack from said handle means is detachably secured on said rack.

7. The apparatus of claim 1, wherein:

said rack includes at least one pair of elongated rails in parallel spaced apart relation having facing internal cavities along the length thereof defining said recess for receiving said plurality of retainer assemblies, said rails having outer surfaces forming a portion of said outer faces.

8. The apparatus of claim 7, including:

at least one pair of internal rails defining wall portions of a first channel of said recess for guiding said retainer assemblies mounted in said rack.

9. The apparatus of claim 8, wherein:

said retainer assemblies include an enlarged polygonal body portion adapted to slide longitudinally in said channel.

10. The apparatus of claim 9, wherein:

said internal rails having surfaces defining wall portions of a second channel for containing said release means of said retainer assemblies.

11. The apparatus of claim 10, wherein:

said release means includes a release button depressible inwardly toward said rack for releasing said detent means.

12. The apparatus of claim 11, wherein:

said release button includes an outer face in said recess exposed through said slot in the other face of said rack for manual depression by the finger of a user.

* * * * *